US007981491B2

(12) United States Patent
Kobayashi

(10) Patent No.: US 7,981,491 B2
(45) Date of Patent: Jul. 19, 2011

(54) PACKAGE FOR INK JET RECORDING MEDIUM

(75) Inventor: Masamichi Kobayashi, Shizuoka-ken (JP)

(73) Assignee: FUJIFILM Corporation, Tokyo (JP)

( * ) Notice: Subject to any disclaimer, the term of this patent is extended or adjusted under 35 U.S.C. 154(b) by 782 days.

(21) Appl. No.: 11/962,403

(22) Filed: Dec. 21, 2007

(65) Prior Publication Data

US 2008/0151031 A1 Jun. 26, 2008

(30) Foreign Application Priority Data

Dec. 26, 2006 (JP) ..... 2006-349949

(51) Int. Cl.
*B41M 5/40* (2006.01)

(52) U.S. Cl. ..... 428/32.34; 428/343; 428/355 R; 428/355 BL

(58) Field of Classification Search ..... 428/32.34, 428/343, 355 R, 355 BL
See application file for complete search history.

(56) References Cited

U.S. PATENT DOCUMENTS

| | | | | |
|---|---|---|---|---|
| 6,919,110 | B2 * | 7/2005 | Oketani et al. | 428/32.34 |
| 2002/0015542 | A1 * | 2/2002 | Bradley | 383/211 |
| 2007/0275200 | A1 * | 11/2007 | Kato et al. | 428/40.1 |

FOREIGN PATENT DOCUMENTS

| | | | |
|---|---|---|---|
| JP | 5-95864 | U | 12/1993 |
| JP | 6-263168 | A | 9/1994 |
| JP | 7-138545 | A | 5/1995 |
| WO | WO 2006/006265 | A1 * | 1/2006 |

* cited by examiner

*Primary Examiner* — Betelhem Shewareged
(74) *Attorney, Agent, or Firm* — Sughrue Mion, PLLC

(57) ABSTRACT

The invention provides an ink jet recording medium package comprising a main body, a flap, and a self-adhesive layer, wherein the main body accommodates an ink jet recording medium and has an opening through which the ink jet recording medium is taken out, the flap closes the opening, the self-adhesive layer allows repeated adhesion of the main body to the flap, and the self-adhesive layer is composed of an olefin-based elastomer.

14 Claims, 2 Drawing Sheets

PACKAGE FOR INK JET RECORDING MEDIUM

CROSS-REFERENCE TO RELATED APPLICATION

This application claims priority under 35 USC 119 from Japanese Patent Application No. 2006-349949, the disclosure of which is incorporated by reference herein.

BACKGROUND OF THE INVENTION

1. Field of the Invention

The present invention relates to a package for packaging an ink jet recording medium recorded with inks ejected by an ink jet process.

2. Description of the Related Art

In recent years, various information processing systems have been developed in response to the rapid development of the information industry, and recording methods and apparatuses suitable for information processing systems have diversified. Among various recording methods, ink jet recording methods are widely used because they are useful for recording on various recording materials, the required equipment is compact and inexpensive, and is also very quiet.

Examples of known recording materials used for ink jet recording processes include those composed of an ink receiving layer on a support, wherein the ink receiving layer is formed by applying a solution containing inorganic fine particles such as silica, a water-soluble resin such as PVA, and a curing agent for the water-soluble resin, and then drying the coating, and the layer receives ink droplets from the outside to record characters, diagrams and the like. The product form of the ink jet recording material is usually a long sheet roll of several meters to several tens of meters, or a sheet stack containing several tens of sheets to about 100 sheets.

When such a recording material is delivered in the form of a sheet stack, a plurality of sheets are stacked, and usually packaged in a package composed of a resin film such as a polypropylene film for the purpose of, for example, storage before use, protection during transportation, or decoration.

When the packaged recording material is used, a necessary number of sheets are taken out through the opening of the package, and then the opening is closed thereby protecting the remaining recording material from stains or damage during storage and transportation. For this purpose, the opening is configured so that it may be opened and closed multiple times.

Specific examples of widely known adhesive materials for packages include an adhesive material such as an acrylate provided on the main body for accommodating a recording material and/or the flap for closing the opening through which the recording material is taken out from the main body, whereby the flap and the main body may be repeatedly bonded together (when the opening is closed) and released (when the opening is opened) (for example, see Japanese Patent Application Laid-Open (JP-A) No. 7-138545).

Common ink jet recording materials are composed of a paper base having thereon an ink receiving layer containing inorganic fine particles such as silica, so that they are heavier than general paper. On this account, in order to prevent the package from opening during distribution or hanging in stores, a material such as poly-2-ethylhexyl acrylate having relatively high adhesiveness is used to allow repeated adhesion (closing) and release (opening) between the flap and the main body.

Another example is a removable adhesive tape composed of an arbitrary adhesive or an acrylic releasable adhesive, the tape allowing repeated adhesion and release (for example, see Japanese Utility Model Application Laid-Open (JP-U) No. 5-95864, and JP-A No. 6-263168).

SUMMARY OF THE INVENTION

The present invention has been made in view of the above circumstances and provides an ink jet recording package.

A first aspect of the invention provides an ink jet recording medium package comprising a main body, a flap, and a self-adhesive layer, wherein the main body accommodates an ink jet recording medium and has an opening through which the ink jet recording medium is taken out, the flap closes the opening, the self-adhesive layer allows repeated adhesion of the main body to the flap, and the self-adhesive layer is composed of an olefin-based elastomer.

DETAILED DESCRIPTION OF THE INVENTION

Figure 1:
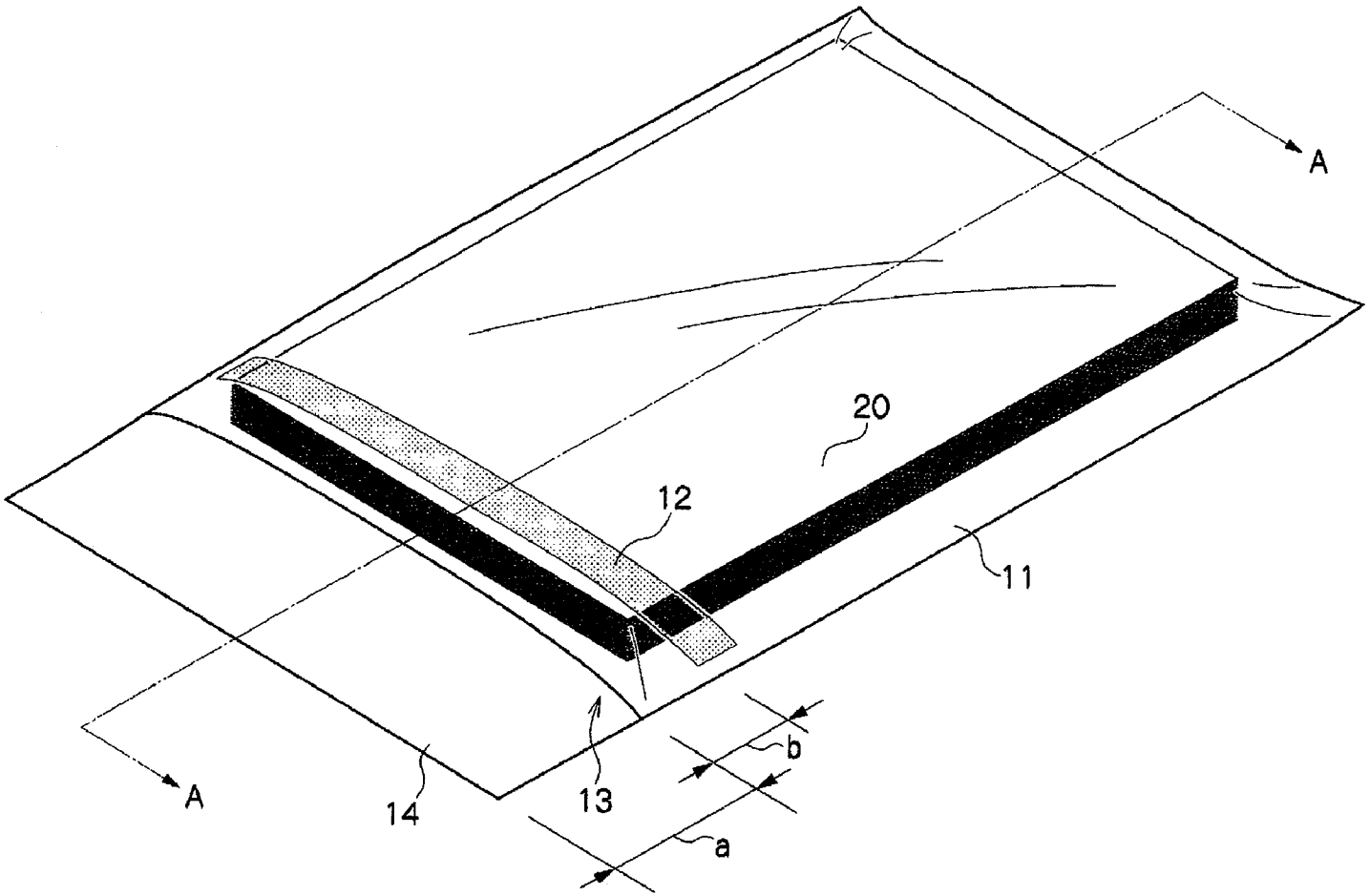
FIG. 1 is a perspective view showing the ink jet recording medium package in accordance with the present invention.
Figure 2:
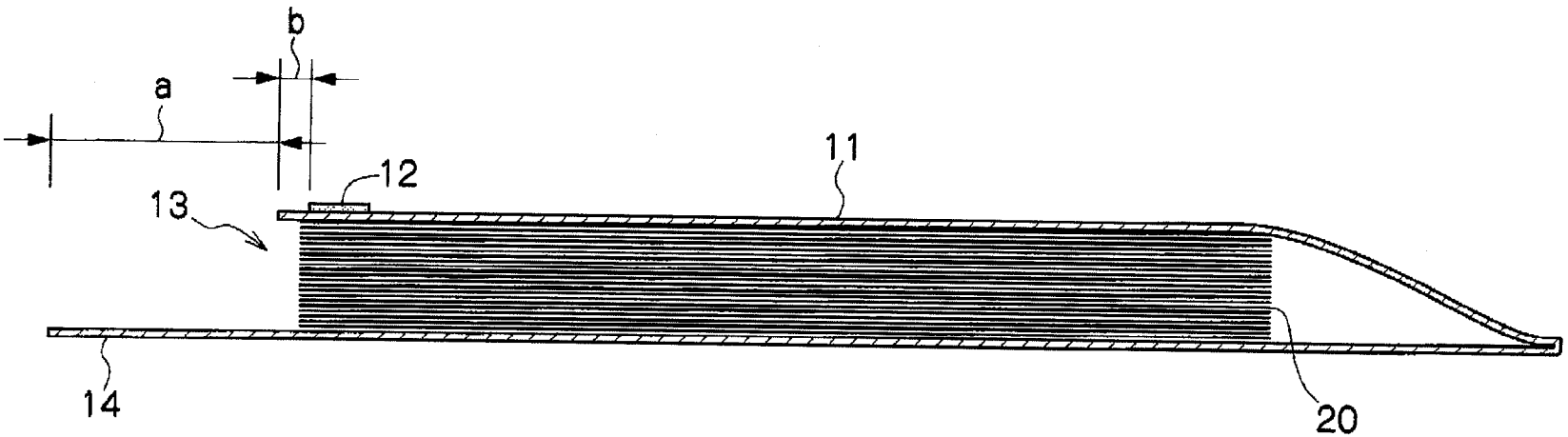
FIG. 2 is a cross sectional view taken along line A-A' in FIG. 1.

Some adhesive materials such as poly-2-ethylhexyl acrylate are excessively adhesive, so that readily adhere to an ink jet recording medium when the ink jet recording medium is taken in and out from the package, and the ink receiving layer may be exfoliated by the adhesive material deposited on the layer.

Even if the ink receiving layer is not exfoliated, the adhesive material residues on the ink receiving layer may partially or completely hinder penetration of inks into the ink receiving layer, which results in the deterioration in quality of the recorded image.

The present invention has been accomplished in view of the above-described problems, and is intended to provided an ink jet recording medium package which favorably maintains continuous transferability during recording (for example, reduction of frequency of double feeding) and image quality (for example, ink absorption properties), wherein age fading of images printed with dye inks is suppressed and the occurrence of banding is prevented with maintaining the adhesive strength of the opening, through which the ink jet recording medium is taken in and out. Suppression of age fading of images printed with dye inks and with the low occurrence of banding due to reduced adhesion of the adhesive material to the ink absorbing layer.

The ink jet recording medium package of the invention is further described below in detail.

The ink jet recording medium package of the invention is composed of a main body, a flap, and a self-adhesive layer, wherein the main body accommodates an ink jet recording medium and has an opening through which the ink jet recording medium is taken out, the flap closes the opening, the self-adhesive layer allows repeated adhesion of the main body to the flap, and the self-adhesive layer is composed of an olefin-based elastomer.

In the invention, in order to close the opening through which the ink jet recording medium in the main body is taken in and out, the self-adhesive layer for attaching the main body of the package to the flap is composed of an olefin-based elastomer as an adhesive material, whereby the self-adhesive layer scarcely adheres to the ink receiving layer while maintaining necessary adhesiveness during transportation and handling. In addition, the contact of the self-adhesive layer with the ink receiving layer will not cause the transfer of the adhesive material to the ink receiving layer or the exfoliation of the ink receiving layer, so that the occurrence of banding is prevented during image recording. Furthermore, continuous transferability during recording (for example, reduction of frequency of double feeding) and the quality of recorded image (particularly ink absorption properties) may be favorably maintained. If an adhesive material having a low polarity is transferred to the ink receiving layer, association of dye inks may be inhibited, which accelerate the age fading of the dye inks. Accordingly, prevention of the transfer of the adhesive material to the ink receiving layer also prevents the age fading of the dye inks.

As shown in FIG. 1, the ink jet recording medium package in accordance with an exemplary embodiment of the invention includes a package main body 11 composed of polypropylene and an Et-Pr self-adhesive layer 12 provided at a portion of the end of the package main body 11.

As shown in FIG. 1, the package main body 11 is in the form of a hollow bag so as to accommodate an ink jet recording medium, one end of which is opened to form an opening 13, and the ink jet recording medium 20 contained in the package main body 11 may be taken out or put back through the opening 13. The opening may be formed at one end, or both ends of the main body such that the ink jet recording medium may be taken out or put back through either opening.

As shown in FIG. 1, in order to form a flap 14 for closing the opening 13, the one end of the package main body 11 on the opening side is formed so as to be partially projected beyond other portions with a distance of a. The flap 14 composed of a projected portion is bent to a position where the end of the flap 14 overlaps with a portion other than the projected portion, whereby the opening 13 is closed.

The Et-Pr self-adhesive layer 12 is provided on the other portion with a distance of b from the end. The flap 14 is bent so as to contact with the Et-Pr self-adhesive layer 12, and then the flap 14 is pressed onto the Et-Pr self-adhesive layer 12, whereby the flap 14 is attached to the package main body 11 with the adhesiveness of the Et-Pr self-adhesive layer 12, and the opening 13 is fixed in a closed state.

The Et-Pr self-adhesive layer 12 is adhesive, and the attached flap may be released to allow repeated adhesion and release.

The term "self-adhesive" refers to the properties of adhering to the surface to be bonded without requiring the application of pressure or heat, or mechanical means.

The Et-Pr self-adhesive layer 12 in accordance with the present exemplary embodiment is TAFMER P028G (a polyethylene/polypropylene copolymer manufactured by Mitsui Chemicals, Inc.) provided in a linear form with a thickness of 40 μm along the end of the portion of the package main body other than the projected portion. The formation of the layer may be carried out by applying a liquid or a highly viscous liquid.

The self-adhesive layer may be selected from a group composed of a polyethylene/polypropylene copolymer (for example, TAFMER P028G herein) or an arbitrary olefin-based elastomer selected in accordance with the intended adhesiveness, the kind of the package, or the intended use.

In the invention, specifically an olefin-based elastomer is selected as the adhesive component of the self-adhesive layer, whereby desired adhesiveness which prevents the package from being opened during distribution or hanging in stores is maintained, the flap and the main body may be repeatedly bonded together (the opening is closed) and released (the opening is opened), and adhesion of the adhesive component to the ink receiving layer is avoided even if, for example, the ink receiving layer of the ink jet recording medium being taken out is brought into contact with or pressed against the self-adhesive layer. As a result of this, the occurrence of banding is effectively suppressed, continuous transfer performance is improved through, for example, reduction of the frequency of double feeding during recording, and image recording is stably carried out with good image quality without deterioration of the ink absorption properties caused by adhesion of the adhesive component. In addition, even if an image is printed with dye inks, adhesion of the adhesive component to the ink receiving layer is avoided to suppress naturally occurring age fading without inhibiting association of dye inks in the image-receiving layer.

Elastomers are classified into thermoplastic elastomers and rubbers, both of which are usable as the olefin-based elastomer of the invention. From the viewpoint of storability of self-adhesiveness, rubbers are preferable.

Examples of the thermoplastic elastomer include polyethylene/α-olefin-based copolymers having a low density (for example, 0.91 or less). Examples of commercial products include TAFMER series manufactured by Mitsui Chemicals, Inc., KERNEL series manufactured by Mitsubishi Chemical Corporation, ELITE series and AFFINITY series manufactured by Dow Chemical Japan.

Among them, those polymerized with a single site catalyst such as a metallocene catalyst are more preferable because they contains less amounts of low molecular weight components.

Specific examples of the thermoplastic elastomer include, in addition to the polyethylene/polypropylene copolymers, 1-butene/ethylene copolymers [for example, TAFMER X611, A4085, and A4090 (trade name) manufactured by Mitsui Chemicals, Inc.], ethylene/vinyl acetate copolymers [for example, EVAFLEX series such as EVAFLEX EV-420, EV-260, V577, and P1207 (trade name) manufactured by Du Pont-Mitsui Polychemicals Co., Ltd.], ethylene/α-olefin copolymers [α-olefin includes 1-butene and propylene (hereinafter the same); for example, TAFMER (trade name) A series such as A4070 and A20090, TAFMER P series such as P0680 and P0880, manufactured by Mitsui Chemicals, Inc.], propylene/α-olefin copolymers [for example, TAFMER (trade name) XR series such as XR110T, and TAFMER S series such as S4030, and TAFMER XM manufactured by Mitsui Chemicals, Inc.].

Examples of the rubber include hydrogenated styrenic thermoplastic elastomers (styrene-butadiene elastomers). From the viewpoint of self-adhesiveness, carboxylic acid-modified rubbers described in JP-A No. 2004-217749, paragraphs [0009] to [0011] are preferable.

Specific examples of the rubber include maleic acid-modified styrene-ethylene-butadiene-styrene copolymers [maleic acid-modified SEBS; for example, Tuftec (trade name) series such as Tuftec M 1911, M 1913, and M 1943, Tuftec P, and Tuftec M manufactured by Asahi Kasei Chemicals Corporation].

Among the above-described olefin-based elastomers, maleic acid-modified SEBS, or commercially available Tuftec M1911 is preferable from the viewpoint of preventing adhesion of the adhesive material to the ink receiving layer and resultant banding while keeping necessary adhesive strength.

In order to control adhesiveness, the self-adhesive layer may contain a crosslinking agent together with the olefin-based elastomer. The crosslinking agent is not particularly limited as to its type, and may be appropriately selected in consideration of the type of the olefin-based elastomer.

Examples of the crosslinking agent include isocyanates, melamine resins, epoxy resins, silane resins, and phenolic resins, and examples of commercial products include CORONATE HL (hexamethylene diisocyanate of buret type) manufactured by Nippon Polyurethane Industry Co., Ltd.

The mass ratio (x:y) between the olefin-based elastomer (x) and the crosslinking agent (y) is not particularly limited, and is preferably, for example, in a range of from 100:1 to 2:1, more preferably from 100:1 to 4:1, and most preferably from 50:1 to 12:1 from the viewpoint of achieving good adhesiveness of the self-adhesive layer to the flap (package main body).

In order to adjust adhesiveness, the self-adhesive layer may contain a plasticizing agent together with the olefin-based elastomer.

The plasticizing agent is not particularly limited as to its type. In cases where the olefin-based elastomer has a polystyrene phase and a rubber phase, the plasticizing agent is preferably a polymer compound having a high affinity for the rubber and a low affinity for the polystyrene phase. Example of such plasticizing agents include naphthene oil and liquid paraffin.

Preferable examples of the naphthene oil include those having a flash point of, for example, from 100 to 300° C., more preferably 150 to 280° C. The naphthene oil preferably has a pour point of from −30 to −5° C., more preferably from −25 to −10° C., and a specific gravity of from 0.83 to 0.87, more preferably from 0.837 to 0.868. In addition, the naphthene oil preferably has 3 to 8 carbon atoms, more preferably 5 to 6 carbon atoms.

The liquid paraffin preferably has a flash point of, for example, from 100 to 300° C., more preferably from 150 to 280° C. The liquid paraffin preferably has a pour point of from −30 to −5° C., more preferably from −25 to −10° C., and preferably has a specific gravity of from 0.89 to 0.91, more preferably from 0.8917 to 0.9065. In addition, the liquid paraffin preferably has, for example, 20 to 35 carbon atoms, more preferably 21 to 33 carbon atoms.

Either of the naphthene oil and liquid paraffin may be used alone, or in combination of them.

The self-adhesive layer may contain other additives such as an anti-static agent. The anti-static agent may be, for example, ELEGAN 264 WAX manufactured by Nippon & Fats Co., Ltd., and the content thereof is preferably from 0.1 to 3.6% by mass, more preferably from 0.6 to 1.8% by mass with reference to the mass of the self-adhesive layer. When the content is within a range, so-called "orange peel surface" is favorably prevented.

Among the above-described examples, the self-adhesive layer is particularly preferably composed of maleic acid-modified SEBS (olefin-based elastomer), hexamethylene diisocyanate (crosslinking agent), and naphthene oil (plasticizing agent) having 6 carbon atoms from the viewpoint of preventing adhesion of the adhesive material to the ink receiving layer and resultant banding while keeping necessary adhesive strength.

The thickness of the self-adhesive layer may be arbitrarily selected within a range which achieves intended adhesiveness to the flap, and is commonly from 1 to 50 μm.

In accordance with the present exemplary embodiment, the Et-Pr self-adhesive layer 12 is provided only on the shorter portion of the package main body 11, however may be provided also on the flap 14 having a longer length.

The material composing the package main body 11 may be polypropylene or other known thermoplastic resins, and examples thereof include polyethylene resins having different densities, ethylene-α-olefin copolymer resins having different densities, high molecular weight polyethylene resins, homopolypropylene resins, propylene-α-olefin copolymer resins, various polyester resins, various polyamide resins, various ethylene copolymer resins, various thermoplastic elastomers, and polyacrylonitrile resins, which may be used alone or as a mixed resin, a polymer alloy, or a modified resin composed of two or more of them. Among them, vinyl chloride-free ones such as polyolefin and polyester are preferably used from the viewpoint of safety.

Preferable examples of the polyolefin include polyethylene, polypropylene, and poly-4-methyl-1-pentene, and preferable examples of the polyester include polyethylene terephthalate and polyethylene naphthalate.

The package main body may be a laminate of various film layers. In this case, the laminate may be prepared by laminating through coextrusion under a tubular film process, or by laminating a plurality of flexible sheets, which have been prepared by separate processes, via an adhesive. In cases where the tubular film process is used, two or three layers may be coextruded.

Examples of the flexible sheet include a resin film composed of a single resin, a mixed, polymer alloy, or modified resin film composed of two or more resins, and monoaxially or biaxially stretched (including molecule orientation) films of these various thermoplastic resin films, wherein examples of the resin include various thermoplastic resin films such as various polyethylene resins, various ethylene copolymer resins, homopolypropylene resins, various propylene copolymer resins, a polyvinyl chloride resin, various polyamide resins, a polyacrylonitrile resin, an ethylene-vinyl alcohol copolymer resin, a polycarbonate resin, and various polyester resins (for example, a PET resin, a PBT resin, an A-PET resin, and a PEN resin). Other examples include triacetate film, cellophane, regenerated cellulose film, paper, synthetic paper, nonwoven fabric, and inorganic substance deposited films made by depositing inorganic substances on the various thermoplastic resin films.

The thickness of the flexible sheet layer is preferably from 5 to 500 μm when the film is not stretched, more preferably from 6 to 400 μm, and most preferably from 7 to 300 μm. In cases where the flexible sheet layer is a monoaxially or biaxially stretched thermoplastic resin film, the thickness of the layer is preferably from 5 to 70 μm, more preferably from 7 to 50 μm, and most preferably from 9 to 30 μm.

The Young's modulus of the flexible sheet is preferably 50 $kg/mm^2$ or more, more preferably 70 $kg/mm^2$ or more, particularly preferably 90 $kg/mm^2$ or more, and most preferably 100 $kg/mm^2$ or more.

Examples of the vapor deposited film of the inorganic substance deposited film include an aluminum deposited film, and a vapor deposited film composed of one or more selected from silicon oxide, aluminum oxide, titanium oxide, tin oxide, zinc oxide, indium oxide, and magnesium oxide. As a transparent inorganic vapor deposited film, single or combine vapor deposited film composed of silicon oxide and/or aluminum oxide is particularly preferable from the viewpoints of suitability for vapor deposition, quality, cost, and photographic properties.

The thickness of the vapor deposited film is preferably from 50 to 3,000 Å, more preferably from 100 to 2,000 Å, particularly preferably from 200 to 1,500 Å, and most preferably 400 to 1,000 Å. When the thickness is within a range, moisture resistance and oxygen barrier properties are secured, and heat degradation and heat shrinkage of the base material are prevented, and excellent quality, cost, and productivity are provided.

The adhesive may be used a known adhesive as appropriate.

The adhesive may be a heat melt type adhesive (extrusion laminating adhesive), and examples thereof include polyolefin-based thermoplastic resins such as various polyethylene (LDPE, L-LDPE, MDPE, HDPE) resins and various polypropylene resins, ethylene copolymer resins such as an ethylene-propylene copolymer resin, an ethylene-vinyl acetate copolymer resin, an ethylene-ethyl acrylate copolymer resin, and special thermoplastic resins such as an ethylene-acrylate copolymer resin, an ionomer resin, and an acid-modified ethylene copolymer resin.

Other examples include heat melt type rubber-based adhesives. Examples of liquid adhesives include wet laminating adhesives of emulsion or latex type. Representative examples of the emulsion type adhesive include polyvinyl acetate, a vinyl acetate-ethylene copolymer, a vinyl acetate-acrylic ester copolymer, a vinyl acetate-maleic acid ester copolymer, an acryl copolymer, and an ethylene-acrylic acid copolymer. Representative examples of the latex type adhesive include rubber latexes such as natural rubber, styrene butadiene rubber (SBR), acrylonitrile butadiene rubber (NBR), and chloroprene rubber (CR).

Examples of dry laminating adhesives include, as described in "Plastic Film, Resin Zairyo Souran '95" (Converting Technical Institute, pp. 859 to 862, Oct. 30, 1995), classified into two-component curing type, solvent type, solvent-free type, aqueous type, two-component solvent type, one-component solvent-free type, two-component solvent-free type, and emulsion type. Specific examples thereof include acrylic adhesives, polyether-based adhesives, mixtures of polyether-based and polyurethane-based adhesives, mixtures of polyester-based and polyurethane-based adhesives, mixtures of polyester-based and isocyanate-based adhesives, aromatic polyester-based adhesives, aliphatic polyester-based adhesives, aromatic polyether-based adhesives, aliphatic polyether-based adhesives, polyester-based adhesives, isocyanate-based adhesives, and polyurethane-based adhesives. Among these adhesives, polyurethane-based adhesives of two-component type is particularly preferable.

The dry thickness of the adhesive is preferably from 0.5 to 8 μm, and more preferably from 1 to 5 μm.

The adhesive may be a known adhesive such as a hot melt laminating adhesive, a pressure-sensitive adhesive, or a heat-sensitive adhesive containing, for example, a paraffin wax, a microcrystalline wax, an ethylene-vinyl acetate copolymer resin, an ethylene-α-olefin copolymer resin, an adhesive resin, or an ethylene-ethyl acrylate copolymer resin.

Polyolefin-based adhesives of extrusion laminating type are also preferable as adhesive.

Specific examples of the polyolefin-based adhesives of extrusion laminating type include homopolyethylene resins, polypropylene resins, polybutylene resins, and ethylene copolymer resins (for example, EVA, EEA, and EAA resins) having different densities; ethylene copolymers with other monomer (α-olefin) such as a L-LDPE resin; ionomer resins (ionic copolymers) such as "SURLYN" manufactured by Dupont K.K., and "HIMILAN" manufactured by Mitsui Polychemical Co., Ltd.; and acid-modified polyolefin resins such as "ADMER" manufactured by Mitsui Petrochemical Industries, Ltd. These resins may be used alone or as a blend resin composed of two or more of them. Other examples also include UV curable adhesives.

Particularly preferable is a LDPE resin, a L-LDPE resin, or a blend resin composed of LDPE and L-LDPE resins from the viewpoints of low cost and suitability for lamination. In order to improve the adhesive strength, 1 to 50% by mass of an acid-modified polyolefin resin is preferably added. From the viewpoint of achieving excellent suitability for lamination, it is particularly preferable that two or more of the above-described resins be blended so as to correct the defects of each resin. It is preferable that a LDPE or L-LDPE resin be blended with an acid-modified polyolefin resin at an appropriate ratio so as to achieve an intended adhesive strength.

In order to achieve a delamination strength of 350 g/15 mm in width or more, particularly preferably 500 g/15 mm in width or more thereby improving easiness of opening, the adhesive is particularly preferably a solvent-free adhesive, a dry laminating adhesive, or a polyolefin-based adhesive of extrusion laminating type containing 5% mass or more of an acid-modified polyolefin resin.

The dry laminating adhesive has following features.

1) The adhesive is dissolved in a solvent before use to sufficiently moisten the base material such as a sheet.

2) The adhesive is suitable to various materials such as paper, thermoplastic resin films, nonwoven fabric, synthesis paper, and cellophane.

3) The adhesive offers stable reactivity and strong adhesiveness.

4) The adhesive allows high exfoliation strength of 400 g/15 mm in width or more to improve easiness of opening.

5) The adhesive offers excellent heat resistance.

6) The adhesive is of reactive type, so that adequate pot life (usable time) is provided after mixing the main component and the curing agent, and mixing with the solvent.

7) The adhesive may be applied as a laminable film to achieve a solid content coating weight of 0.5 to 10 g/m$^2$, preferably 1 to 8 g/m$^2$, and particularly preferably 1.5 to 6 g/m$^2$.

8) The coating weight of the adhesive may be accurately controlled under a gravure coating method (combined with a smoothing bar); complete curing requires aging at 30 to 65° C. for 1 to 5 days.

Among the above-described dry laminating adhesives, the dry laminating adhesive of one-component solvent-free type is also preferable. The dry laminating adhesive is composed mainly of a polyurethane-based adhesive, and is a hot melt type adhesive which is heated to 60 to 110° C. to decrease the viscosity to 3,000 cps or lower thereby minimizing the coating weight. The adhesive also requires the decrease of the molecular weight and coating weight. The adhesive requires a shorter time than the dry lamination process, and readily dries (or requires no drying under certain circumstances). The adhesive requires a very small amount of coating weight as low as 5 g/m$^2$ or less, preferably 3 g/m$^2$ or less, particularly preferably from 0.3 to 2 g/m$^2$, and most preferably from 0.5 to 1.5 g/m$^2$, so that the coating weight must be accurately controlled. Accordingly, a multi-roll coating system using three or more rolls, preferably four or more rolls is preferably used.

According to the present exemplary embodiment, an olefin-based elastomer is provided directly on the surface of the package main body 11 thereby forming the Et-Pr self-adhesive layer. Alternatively, the self-adhesive layer may be formed on a supporting material provided on the package main body 11, according to the material and surface properties of the package main body 11, and the type of the olefin-based elastomer.

The supporting material is not particularly limited, however is preferably, for example, a plastic film. Examples of the plastic film include polyester-based resins such as polyethylene terephthalate (PET) and polybutylene terephthalate, polyolefins, polyamides, polycarbonates, acrylic resins, polyvinyl chloride, and paper. Among them, PET is particularly preferable. Examples of commercial products include LUMIRROR 50T60 (without adhesion-promoting treatment) manufactured by Toray Industries, Inc., and EMBLET 38SC (one side corona treated PET) manufactured by Unitika, Ltd.

The thickness of the supporting material may be arbitrarily selected, and is, for example, preferably in a range of from 10 to 350 μm, more preferably from 25 to 70 μm.

The supporting material may be subjected to adhesion-promoting treatment (for example, corona treatment, plasma treatment, or blast treatment), preferably corona-treatment on at least one side, or one side or other side, preferably one side.

The supporting material may contain other additives such as a pigment, a dye, an antioxidant, an age inhibitor, a filler, an ultraviolet absorber, an anti-static agent and/or an electromagnetic shielding agent wave within a range which will not impair the effects of the invention.

The ink jet recording medium package of the invention is a package for accommodating an ink jet recording medium, and, as shown in FIG. 1, one sheet or a plurality of sheets of the ink jet recording medium accommodated therein is taken out or put back as necessary through the opening provided at least one end of the package. The ink jet recording medium to be accommodated has at least one ink receiving layer on at least one side of the support. Ink droplets are applied from the outside (for example, ejected from a nozzle) onto the ink receiving layer thereby recording an image.

The overview of the ink jet recording medium is described below.

In the invention, the ink receiving layer contains at least one kind of inorganic fine particles, and may be composed mainly of inorganic fine particles.

The statement "composed mainly of inorganic fine particles" means that the ink receiving layer contains 50% by mass or more of inorganic fine particles, preferably 60% by mass or more, and particularly preferably 65% by mass or more with reference to the total solid content.

The total amount of the inorganic fine particles in the ink receiving layer (when two or more ink receiving layers are composed mainly of inorganic fine particles, the total amount of the inorganic fine particles) is preferably in a range of from 10 to 50 g/m$^2$, more preferably from 15 to 40 g/m$^2$.

The inorganic fine particles is not particularly limited as to the type, and is preferably fumed silica, alumina, or alumina hydrate from the viewpoints of glossiness and ink absorption properties. These inorganic fine particles may be used alone or in combination of them.

The ink receiving layer may be composed of a single layer or a plurality of layers. In cases where the ink receiving layer has a single layer structure, for example, the layer may contain any one kind of or a plurality of kinds of particles selected from fumed silica, alumina, and an alumina hydrate. In cases where the ink receiving layer is composed of a plurality of layers, for example, the plurality of layers may contain one kind of or different kinds of particles selected from fumed silica, alumina, and an alumina hydrate. Specific examples of the layer structure include a two-layer structure composed of a fumed silica-containing layer and an alumina- or alumina hydrate-containing layer, and a multilayer structure wherein the layers contain fumed silica having different particle diameters.

General silica fine particles are broadly classified into wet process particles and dry process (gas phase process) particles depending on the manufacturing method. Under a gas phase process, anhydrous silica is usually produced by hydrolysis of silicon halide in a high-temperature gas phase (flame hydrolysis process), or by reductively heating silica sand and cokes by arcing in an electric furnace, followed by oxidation with air (arc process). The "fumed silica" refers to fine particles of anhydrous silica produced by a gas phase process. The wet process is usually conducted by forming active silica through acid decomposition of silicate, and then appropriately polymerizing the active silica to obtain hydrous silica through coagulation sedimentation.

Examples of commercially available fumed silica include AEROSIL series manufactured by Nippon Aerosil Co., Ltd. and QS Type manufactured by Tokuyama Corp.

Fumed silica is different from hydrous silica in, for example, the density of the silanol groups on the surface, and the presence or absence of pores, so that they exhibit different properties. Fumed silica is suitable to form a three-dimensional structure having a high porosity. The reason is not evident, however is considered as follows: hydrous silica tends to densely aggregate because it has as much as 5 to 8 silanol groups per square nanometers of the particle surfaces, while fumed silica tends to sparsely flocculate because it has 2 to 3 silanol groups per square nanometers of the particle surfaces, which results in a structure having a high porosity.

Fumed silica has a particularly large specific surface area, so that is highly efficient in ink absorption and retention. In addition, fumed silica has a low refractive index, so that imparts transparency to the ink receiving layer when dispersed to an appropriate particle diameter thereby providing a high color density and favorable color development properties. Transparency of the ink receiving layer is important from the viewpoint of achieving a high color density, favorable color development properties, and glossiness even when the layer is applied to a photographic glossy paper or the like.

The fumed silica preferably has an average primary particle diameter of from 5 to 50 nm, and in order to achieve higher glossiness, preferably has an average primary particle diameter of from 5 to 20 nm, and a specific surface area of from 90 to 400 m$^2$/g under a BET process. The BET process is a method for measuring the surface area of powder by a vapor phase adsorption method, wherein the total surface area of 1 g of a sample, i.e., the specific surface area is determined from an adsorption isotherm. In usual cases, nitrogen gas is adsorbed, and the adsorbed amount is determined from the variation in the pressure or volume of the adsorbed gas. The most remarkable equation for representing isotherm of polymolecular adsorption is a Brunauer-Emmett-Teller equation or so-called BET equation, which is widely used for determining the surface area. The absorbed amount is determined on the basis of the BET equation, and is multiplied by a surface area of one adsorbed molecule to determine the surface area.

The alumina is preferably γ-alumina composed of γ crystals of aluminum oxide, and the crystals are most preferably δ group crystals. γ-alumina may be minimized to primary particles of about 10 nm, however in usual cases, preferable are those having a diameter of about 50 to 300 nm obtained by pulverizing secondary particle crystals of several thousands to several ten thousands of nanometers using, for example, an ultrasonic or high-pressure homogenizer or a particle collision type jet mill.

The alumina hydrate is expressed by a structural formula of $Al_2O_3.nH_2O$ (n=1 to 3). When n is 1, the alumina hydrate has a boehmite structure, and when n is more than 1 and less than 3, the alumina hydrate has a pseudo-boehmite structure. Alumina hydrate is obtained by a known production process such as hydrolysis of an aluminum alkoxide such as aluminum isopropoxide, neutralization of an aluminum salt with an alkali, or hydrolysis of aluminate.

The average particle diameter of the primary particles of the alumina hydrate is preferably from 5 to 50 nm. In order to achieve higher glossiness, it is preferable to use tabular particles having an average primary particle diameter of from 5 to 20 nm and an average aspect ratio (ratio of the average particle diameter to the average thickness) of 2 or more.

The ink receiving layer preferably contains an organic binder to maintain film properties. Preferable examples of the organic binder include various water-soluble polymers and polymer latexes. Examples of the water-soluble polymer include polyvinyl alcohol, polyethylene glycol, starch, dextrin, carboxymethyl cellulose, polyvinyl pyrrolidone, polyacrylic esters, and derivatives thereof. The organic binder is particularly preferably a completely or partially saponified polyvinyl alcohol or a cation-modified polyvinyl alcohol.

Among the polyvinyl alcohols, particularly preferable are completely or partially saponified ones having a degree of saponification of 80% or more.

The polyvinyl alcohol preferably has an average degree of polymerization of from 500 to 5000. Examples of the cation-modified polyvinyl alcohol include polyvinyl alcohols as described in JP-A No. 61-10483, which have a primary to tertiary amino group or a quaternary ammonium group in the main chain or side chain thereof.

The polymer latex as an organic binder is, for example, an acrylic latex, and examples thereof include: acrylic esters or methacrylic esters having an alkyl group, an aryl group, an aralkyl group, or a hydroxyalkyl group; homopolymers or copolymers of acrylonitrile, acrylamide, acrylic acid and methacrylic acid; and copolymers of the monomers with styrenesulfonic acid, vinylsulfonic acid, itaconic acid, maleic acid, fumaric acid, maleic anhydride, vinyl isocyanate, allyl isocyanate, vinyl methyl ether, vinyl acetate, styrene, and divinylbenzene. Another preferable example is an olefin-based latex such as a polymer composed of a vinyl monomer and a diolefin-based copolymer, and examples of the vinyl monomer include styrene, acrylonitrile, methacrylonitrile, methyl acrylate, methyl methacrylate, and vinyl acetate, and examples of the diolefin include butadiene, isoprene, and chloroprene.

The content of the organic binder in the ink receiving layer is preferably in a range of from 5 to 35% by mass, particularly preferably from 10 to 30% by mass with reference to the inorganic fine particles.

In cases where the ink receiving layer contains fumed silica as the inorganic fine particles, the layer preferably further contains a cationic compound. The addition of the cationic compound to the ink receiving layer improves the resistance of the layer to cracking and moisture.

In addition, when a layer containing a colloidal silica and a cationic compound is formed on the ink receiving layer containing the cationic compound, scratch resistance, moisture resistance, and ink absorption properties are further improved, and aggregation at the interface between the two layers is avoided to prevent uneven application or uneven glossiness.

When the inorganic fine particles are alumina or an alumina hydrate, the addition of the cationic compound may be not necessary to sufficiently prevent cracks and achieve moisture resistance.

The cationic compound is preferably a cationic polymer or a water-soluble polyvalent metal compound. The cationic polymer and water-soluble polyvalent metal compound may be used alone or in combination of two or more of them.

Examples of the cationic polymer include water-soluble cationic polymers having a quaternary ammonium group, a phosphonium group, or an acid adduct having primary to tertiary amine. Specific examples thereof include polyethyleneimine, polydialkyldiallylamine, polyallylamine, alkylamine epichlorohydrin polycondensate, and cationic polymers described in JP-A Nos. 59-20696, 59-33176, 59-33177, 59-155088, 60-11389, 60-49990, 60-83882, 60-109894, 62-198493, 63-49478, 63-115780, 63-280681, 1-40371, 6-234268, 7-125411, and 10-193776.

The weight average molecular weight of the cationic polymer is preferably 100,000 or less, more preferably 50,000 or less, and the lower limit thereof is about 2,000.

The content of the cationic polymer is preferably from 1 to 10% by mass with reference to the inorganic fine particles.

Examples of the polyvalent metal in the water-soluble polyvalent metal compound include calcium, barium, manganese, copper, cobalt, nickel, aluminum, iron, zinc, zirconium, titanium, chromium, magnesium, tungsten, and molybdenum, which may be used as water-soluble salts of these metals. Specific example of the water-soluble salt include calcium acetate, calcium chloride, calcium formate, calcium sulfate, barium acetate, barium sulfate, barium phosphate, manganese chloride, manganese acetate, manganese formate dihydrate, manganese sulfate ammonium hexahydrate, cupric chloride, copper (II) ammonium chloride dihydrate, copper sulfate, cobalt chloride, cobalt thiocyanate, cobalt sulfate, nickel sulfate hexahydrate, nickel chloride hexahydrate, nickel acetate tetrahydrate, ammonium nickel sulfate hexahydrate, amide nickel sulfate tetrahydrate, aluminum sulfate, aluminum sulfite, thioaluminum sulfate, poly aluminum chloride, aluminum nitrate nonahydrate, aluminum chloride hexahydrate, ferrous bromide, ferrous chloride, ferric chloride, ferrous sulfate, ferric sulfate, zinc bromide, zinc chloride, zinc nitrate hexahydrate, zinc sulfate, zirconium acetate, zirconium nitrate, basic zirconium carbonate, zirconium hydroxide, ammonium zirconium carbonate, potassium zirconium carbonate, zirconium sulfate, zirconium fluoride, zirconium chloride, zirconium chloride octahydrate, zirconium oxychloride, zirconium hydroxychloride, titanium chloride, titanium sulfate, chromium acetate, chromium sulfate, magnesium sulfate, magnesium chloride hexahydrate, magnesium citrate nonahydrate, sodium phosphotungstate, sodium tungsten citrate, 12-tungstosilicic acid n-hydrate, 12-tungstosilicic acid 26-hydrate, molybdenum chloride, and 12-molybdophosphoric n-hydrate. Among them, water-soluble salts of aluminum or elements of periodic table IVa group (zirconium and titanium) are particularly preferable.

In the invention, "water-soluble" means that 1% by mass or more of the substance is soluble in water at normal temperature and under normal pressure.

In addition to the above-described water-soluble aluminum compounds, basic poly aluminum hydroxide compounds are also preferable. The main component of the compounds is expressed by the following formula 1, 2, or 3. The water-soluble poly aluminum hydroxide contains a basic, polymeric polynuclear condensed ion in a stable form, such as $[Al_6(OH)_{15}]^{3+}$, $[Al_8(OH)_{20}]^{4+}$, $[Al_{13}(OH)_{34}]^{5+}$, and $[Al_{21}(OH)_{60}]^{3+}$.

$$[Al_2(OH)_nCl_{6-n}]_m \quad \text{Formula 1}$$

$$[Al(OH)_3]_nAlCl_3 \quad \text{Formula 2}$$

$$Al_n(OH)_mCl_{(3n-m)}\ (0 \leqq m \leqq 3n) \quad \text{Formula 3}$$

Examples of commercially available products thereof include poly aluminum chloride as a water-treating agent (trade name: PAC, manufactured by Taki Chemical Co., Ltd.), poly aluminum hydroxide (trade name: Paho, manufactured by Asada Chemical Industry Co., Ltd.; trade name: PURACHEM WT, manufactured by Riken Green Co., Ltd.). Other products of various grades for similar purposes are available from other manufacturers.

In the invention, these commercial products may be used as supplied. These basic poly aluminum hydroxide compounds are also described in Japanese Patent Application Publication (JP-B) Nos. 3-24907 and 3-42591.

The content of the water-soluble polyvalent metal compound in the ink receiving layer is preferably from 0.1 g/m$^2$ to 10 g/m$^2$, more preferably from 0.2 g/m$^2$ to 5 g/m$^2$.

The ink receiving layer may contain various oil droplets for the purpose of improve vulnerability of the film.

Examples of the oil droplets include hydrophobic high-boiling organic solvents having water solubility of 0.01% by mass or less at room temperature (for example, liquid paraffin, dioctyl phthalate, tricresyl phosphate, and silicon oil), polymer particles (for example, particles prepared by polymerizing one or more kinds of polymerizable monomer such as styrene, butyl acrylate, divinylbenzene, butyl methacrylate, and hydroxyethyl methacrylate). The amount of the oil droplets is preferably in a range of from 10 to 50% by mass with reference to the hydrophilic binder.

The ink receiving layer preferably contains, in addition to the organic binder, a hardener for hardening the organic binder.

Specific examples of the hardener include: aldehyde-based compounds such as formaldehyde and glutaraldehyde; ketone compounds such as diacetyl and chloropentanedione; reactive halogen-containing compounds such as bis(2-chloroethylurea)-2-hydroxy-4,6-dichloro-1,3,5triazine and those described in U.S. Pat. No. 3,288,775; reactive olefin-containing compound such as divinylsulfone and those described in U.S. Pat. No. 3,635,718; N-methylol compounds as described in U.S. Pat. No. 2,732,316; isocyanates as described in U.S. Pat. No. 3,103,437; aziridine compounds as described in U.S. Pat. Nos. 3,017,280, and 2,983,611; carbodiimide-based compounds as described in U.S. Pat. No. 3,100,704; epoxy compounds as described in U.S. Pat. No. 3,091,537; halogen carboxy aldehydes such as mucochloric acid; dioxane derivatives such as dihydroxydioxane; and inorganic hardeners such as chromium alum, zirconium sulfate, boric acid, and borate. These hardeners may be used alone or in combination of two or more of them.

Among them, boric acid or borate is particularly preferable.

The loading of the hardener is preferably from 0.1 to 40% by mass, more preferably from 0.5 to 30% by mass with reference to the organic binder composing the ink receiving layer.

The ink receiving layer may further be contained various known additives such as a color dye, a color pigment, an ink dye fixer, an ultraviolet absorber, an antioxidant, a pigment dispersant, an anti-foaming agent, a leveling agent, a preservative, an optical brightener, a viscosity stabilizer, and a pH adjusting agent.

In the ink jet recording medium of the invention, a colloidal silica layer containing a colloidal silica and a cationic compound may be provided on the ink receiving layer. The colloidal silica layer is preferably the outermost layer placed farthest from the support.

In cases where the colloidal silica layer is provided on the ink receiving layer, the coating solution for forming the ink receiving layer preferably has a pH in a range of from 3.3 to 6.0 (particularly in a range of from 3.5 to 5.5). Combination of the pH of the ink receiving layer coating solution and the pH of the colloidal silica layer coating solution (from 3.3 to 6.0) further improves ink absorption properties and glossiness to give a uniform coating.

The colloidal silica is an aqueous colloidal dispersion of silicon dioxide obtained by double decomposition of sodium silicate with an acid or the like, or high-temperature aging of a silica sol passed through an ion exchange resin layer, and is a synthetic wet process silica having an average primary particle diameter of several nanometers to about 100 nm. Examples of the colloidal silica include SNOWTEX ST-20, ST-30, ST-40, ST-C, ST-N, ST-20L, ST-O, ST-OL, ST-S, ST-XS, ST-XL, ST-YL, ST-ZL, ST-OZL, and ST-AK manufactured by Nissan Chemical Industries, Ltd.

The colloidal silica preferably has an average primary particle diameter of from 30 nm to 100 nm from the viewpoints of ink absorption properties and glossiness. It is preferable that two or more kinds of colloidal silica having different average primary particle diameters be combined. In this case, the combination of a colloidal silica having an average primary particle diameter of 30 nm or more and less than 60 nm and another colloidal silica having an average primary particle diameter of 60 nm or more and 100 nm or less is preferable. The ratio of the "colloidal silica having an average primary particle diameter of 30 nm or more and less than 60 nm" to the total amount of the colloidal silica is preferably 60% by mass or more.

The particle form of the colloidal silica is, for example, spherical, or chain (beaded). From the viewpoints of scratch resistance and glossiness, the colloidal silica is preferably spherical. The colloidal silica may be anionic, nonionic, or cationic, and is preferably anionic from the viewpoint of stability of the colloidal silica layer coating solution, particularly stability of the coating solution containing polyvinyl alcohol as an organic binder (prevention of aggregation or separation of the colloidal silica with aging of the coating solution).

The solid content of the colloidal silica in the colloidal silica layer is preferably from 0.1 to 8.0 g/m$^2$, more preferably from 0.3 to 5.0 g/m$^2$. When the content is within a range, glossiness and scratch resistance are further improved without deterioration in ink absorption properties.

The cationic compound is preferably a cationic polymer or a water-soluble polyvalent metal compound. The details about the cationic polymer and water-soluble polyvalent metal compound are the same as described above. The cationic compound contained in the colloidal silica layer is preferably a cationic polymer.

The amount of the cationic polymer is preferably from 0.1 to 10% by mass, more preferably from 0.5 to 8.0% by mass with reference to the colloidal silica.

The colloidal silica layer preferably further contains an organic binder. The amount of the organic binder is preferably 10% by mass or less, more preferably from 1 to 7% by mass with reference to the colloidal silica, and the lower limit is about 0.5% by mass. When the amount of the organic binder is within a range, scratch resistance is further improved without deterioration in ink absorption properties.

The organic binder is the same as the organic binder contained in the ink receiving layer. Particularly preferable are completely or partially saponified polyvinyl alcohols or cation-modified polyvinyl alcohols. Among the polyvinyl alcohols, particularly preferable are completely or partially saponified polyvinyl alcohols having a degree of saponification of 80% or more. The polyvinyl alcohol preferably has an average degree of polymerization of from 500 to 5,000.

Examples of the cation-modified polyvinyl alcohol include polyvinyl alcohols as described in JP-A No. 61-10483, which have a primary to tertiary amino group or a quaternary ammonium group in the main chain or side chain thereof.

The colloidal silica layer may contain a hardener together with the organic binder. The hardener may be the same hardener contained in the ink receiving layer. The hardener is particularly preferably boric acid or borate. The colloidal silica layer may contain other components such as a surfactant, a color dye, a color pigment, an ultraviolet absorber, an antioxidant, a pigment dispersant, an anti-foaming agent, a leveling agent, a preservative, an optical brightener, a viscosity stabilizer, and a pH adjusting agent.

In cases where the ink receiving layer and the colloidal silica layer are formed by application, the formation may be carried out by sequentially applying the layers using, for example, a blade coater, an air knife coater, a roll coater, a bar coater, a gravure coater, or a reverse coater, or by simultaneously applying the layers using, for example, a slide bead coater or a slide curtain coater. The simultaneous multilayer application method is preferable.

Under the simultaneous multilayer application method, a plurality of coating solutions for forming the ink receiving layer and the colloidal silica layer are applied in separate layers onto a support using a coater such as a slide bead coater or a slide curtain coater.

The support composing the ink jet recording medium is preferably a water-resistant support such as: a plastic resin film composed of a polyester resin such as polyethylene terephthalate, a diacetate resin, a triacetate resin, an acrylic resin, a polycarbonate resin, polyvinyl chloride, a polyimide resin, cellophane, or celluloid; a laminate of paper and a resin film; and a polyolefin resin-coated paper composed of paper at least one side of which is bonded to a hydrophobic resin such as a polyolefin resin.

The thickness of the water-resistant support is from 50 to 300 μm, and more preferably from 80 to 260 μm.

EXAMPLES

The invention is further illustrated with reference to the following examples, however the invention is not limited to the examples without departing from the scope of the invention. Unless otherwise noted, "part" and "%" are based on the mass.

Example 1

A photographic paper (trade name: CRISPIA of high glossy type, manufactured by Seiko Epson Corporation) as an ink jet recording medium and the package therefor were provided.

Subsequently, 13 parts of TAFMER P028G (manufactured by Mitsui Chemicals, Inc.) were dissolved in 87 parts of toluene using a propeller stirrer (solid content: 13%). To 100 parts of the solution, 0.13 parts of ELEGAN 264 WAX (cationic anti-static agent manufactured by Nippon & Fats Co., Ltd.) were added to prevent static charges during application, and thus the adhesive material was prepared.

The thus obtained adhesive material was applied onto the surface of the package (polypropylene) of the "photographic paper CRISPIA" using a Mayer bar, and dried at 120° C. for 40 seconds to form an adhesive layer on the package with a thickness of 2 μm.

Example 2

An adhesive layer was provided in the same manner as Example 1, except that TAFMER P028G used for the preparation of the adhesive material was replaced with TAFMER X611 (manufactured by Mitsui Chemicals, Inc.).

Example 3

An adhesive layer was provided in the same manner as Example 1, except that TAFMER P028G used for the preparation of the adhesive material was replaced with EV-420 (manufactured by Du Pont-Mitsui Polychemicals Co., Ltd.).

Example 4

An adhesive layer was provided in the same manner as Example 1, except that TAFMER P028G used for the preparation of the adhesive material was replaced with TAFMER A4070 (manufactured by Mitsui Chemicals, Inc.).

Example 5

An adhesive layer was provided in the same manner as Example 1, except that TAFMER P028G used for the preparation of the adhesive material was replaced with Tuftec M1911 (manufactured by Asahi Kasei Chemicals Corporation).

Example 6

An adhesive layer was provided in the same manner as Example 5, except that 1.04 parts of CORONATE HL (hexamethylene diisocyanate of buret type, manufactured by Nippon Polyurethane Industry Co., Ltd; crosslinking agent) were additionally added to prepare the adhesive material of Example 5.

Example 7

An adhesive layer was provided in the same manner as Example 6, except that 5 parts of COSMO SUPER FREEZE 32 (plasticizing agent manufactured by Cosmo Oil Lubricants Co., Ltd.) were additionally added to prepare the adhesive material of Example 6.

Comparative Example 1

A photographic paper (trade name: CRISPIA of high glossy type, manufactured by Seiko Epson Corporation) as an ink jet recording medium and the package therefor were used for comparison.

(Evaluation)

The adhesive layer of Examples and the adhesive portion of Comparative Example were subjected to the following evaluations. The evaluation results are summarized in Table 1.

—1. Stains on Ink Image-Receiving Layer—

A 5 cm×5 cm sample piece of "photographic paper CRISPIA" was placed on the adhesive layer or adhesive portion on the package of "photographic paper CRISPIA" with the image-receiving layer surface contacting with the package, and was left standing for one hour under a loading of 50 g/0.01 $m^2$. After standing, the sample piece was slowly removed. The conditions of the image-receiving layer surface of the sample was observed under a white fluorescent lamp, and the degree of stains were evaluated in accordance with the following criteria.

<Evaluation Criteria>

A: No trace of adhesive

B: Slight trace of adhesive

C: Remarkable trace of adhesive

D: Exfoliation of image-receiving layer

—2. Banding—

An L-size sheet of "photographic paper CRISPIA" was placed on the adhesive layer or adhesive portion on the package of "photographic paper CRISPIA" with the surface having no image-receiving layer (back side) contacting with the package, and was left standing for one hour under a loading of 50 g/0.01 $m^2$. After standing, a black uniform image was recorded on the sample using an ink jet printer (trade name: A-950, manufactured by Seiko Epson Corporation), and the image was evaluated in terms of banding in accordance with the following criteria.

<Evaluation Criteria>

A: Uniform image with no banding

B: Allowable slight banding

C: Striped banding at regular intervals

D: Striped banding throughout the image

—3. Gas Resistance—

In the same manner as the evaluation of "2. Banding", a sheet of "photographic paper CRISPIA" was placed on the package with the adhesive layer or adhesive portion contacting with the image-receiving layer of "photographic paper CRISPIA". The interface between the adhesive layer or adhesive portion of the package and the image-receiving layer was measured for gas resistance (image residual rate) in accordance with the method described in JP-A No. 2003-1931, paragraph [0129], and evaluated in terms of age fading.

TABLE 1

| | Self adhesive layer | | | | | |
|---|---|---|---|---|---|---|
| | Olefin-based elastomer | Crosslinking agent | Plasticizing agent | Surface stains on ink receiving layer | Banding | Gas resistance |
| Example 1 | TAFMER P028G (*1) | — | — | B | B | B |
| Example 2 | TAFMER X611 (*1) | — | — | B | B | B |
| Example 3 | EV-420 (*2) | — | — | B | B | B |
| Example 4 | TAFMER A4070 (*1) | — | — | B | B | B |
| Example 5 | Tuftec M1911 (*3) | — | — | A | A | A |
| Example 6 | Tuftec M1911 (*3) | CORONATE HL | — | B | B | B |
| Example 7 | Tuftec M1911 (*3) | CORONATE HL | Naphthene oil | B | B | B |
| Comparative Example 1 | Photographic paper CRISPIA | | | D | D | D |

(*1): Manufactured by Mitsui Chemicals, Inc.

(*2): Manufactured by Du Pont-Mitsui Polychemicals Co., Ltd.

(*3): Manufactured by Asahi Kasei Chemicals Corporation

As shown in Table 1, the ink receiving layers of Examples had no stain, and suppressed the occurrence of banding and fading of the dye ink. Accordingly, Examples maintain uniform ink absorption properties and form high quality images. In addition, double feeding or other troubles did not occur during recording of the black image, and continuous transferability was favorable.

On the other hand, "photographic paper CRISPIA" used for comparison caused exfoliation of the image-receiving layer, striped banding throughout the image, and significant fading of the dye ink.

The invention provides an ink jet recording medium package which favorably maintains continuous transferability during recording (for example, reduction of frequency of double feeding) and image quality (for example, ink absorption properties), wherein age fading of images printed with dye inks is suppressed and the occurrence of banding is prevented with maintaining the adhesive strength of the opening, through which the ink jet recording medium is taken in and out.

The invention also includes the following embodiments.

<1> An ink jet recording medium package comprising a main body, a flap, and a self-adhesive layer, wherein the main body accommodates an ink jet recording medium and has an opening through which the ink jet recording medium is taken out, the flap closes the opening, the self-adhesive layer allows repeated adhesion of the main body to the flap, and the self-adhesive layer is composed of an olefin-based elastomer.

<2> The ink jet recording medium package of item <1>, wherein the self-adhesive layer further comprises a crosslinking agent.

<3> The ink jet recording medium package of item <2>, wherein the mass ratio (x:y) between the olefin-based elastomer (x) and the crosslinking agent (y) is in a range of from 100:1 to 2:1.

<4> The ink jet recording medium package of any one of items <1> to <3>, wherein the self-adhesive layer further comprises a plasticizing agent.

<5> The ink jet recording medium package of item <4>, wherein the plasticizing agent is naphthene oil or liquid paraffin.

<6> The ink jet recording medium package of any one of items <2> to <5>, wherein the self-adhesive layer comprises maleic acid-modified styrene-ethylene-butadiene-styrene copolymers (olefin-based elastomer), hexamethylene diisocyanate (crosslinking agent), and naphthene oil having 6 carbon atoms (plasticizing agent).

<7> The ink jet recording medium package of any one of items <1> to <6>, wherein the thickness of the adhesive layer is from 1 to 50 μm.

<8> The ink jet recording medium package of any one of items <1> to <7>, wherein a receiving layer of the ink recording medium contains 65% by mass or more of inorganic fine particles.

All publications, patent applications, and technical standards mentioned in this specification are herein incorporated by reference to the same extent as if such individual publication, patent application, or technical standard was specifically and individually indicated to be incorporated by reference.

It will be obvious to those having skill in the art that many changes may be made in the above-described details of the preferred embodiments of the present invention. The scope of the invention, therefore, should be determined by the following claims.

What is claimed is:

1. An ink jet recording medium package comprising a main body, a flap, and a self-adhesive layer, wherein the main body accommodates an ink jet recording medium and has an opening on an opening side through which the ink jet recording medium is taken out, the flap closes the opening, the self-adhesive layer allows repeated adhesion of the main body to the flap, and the self-adhesive layer is composed of an olefin-based elastomer, wherein the flap composes one end of the main body on the opening side, the flap being formed so as to be partially projected beyond other portions of the main body; and wherein the self-adhesive layer is provided on a portion of the other portions.

2. An ink jet recording medium package comprising a main body, a flap, and a self-adhesive layer, wherein the main body accommodates an ink jet recording medium and has an opening on an opening side through which the ink jet recording medium is taken out, the flap closes the opening, the self-adhesive layer allows repeated adhesion of the main body to the flap, and the self-adhesive layer is composed of an olefin-based elastomer and a crosslinking agent wherein the flap composes one end of the main body on the opening side, the flap being formed so as to be partially projected beyond other portions of the main body; and wherein the self-adhesive layer is provided on a portion of the other portions.

3. The ink jet recording medium package of claim 1, wherein the self-adhesive layer further comprises a plasticizing agent.

4. The ink jet recording medium package of claim 1, wherein the thickness of the self-adhesive layer is from 1 to 50 mm.

5. The ink jet recording medium package of claim 2, wherein the self-adhesive layer further comprises a plasticizing agent.

6. The ink jet recording medium package of claim 2, wherein the mass ratio (x:y) between the olefin-based elastomer (x) and the crosslinking agent (y) is in a range of from 100:1 to 2:1.

7. The ink jet recording medium package of claim 3, wherein the plasticizing agent is naphthene oil or liquid paraffin.

8. The ink jet recording medium package of claim 3, wherein the thickness of the adhesive layer is from 1 to 50 mm.

9. The ink jet recording medium package of claim 5, wherein the self-adhesive layer comprises maleic acid-modified styrene-ethylene-butadiene-styrene copolymers, hexamethylene diisocyanate, and naphthene oil having 6 carbon atoms.

10. The ink jet recording medium package of claim 1, wherein a receiving layer of the ink jet recording medium contains 65% by mass or more of inorganic fine particles with respect to the total solid content.

11. The ink jet recording medium package of claim 10, wherein the self-adhesive layer further comprises a crosslinking agent.

12. The ink jet recording medium package of claim 11, wherein the self-adhesive layer further comprises a plasticizing agent.

13. The ink jet recording medium package of claim 11, wherein the mass ratio (x:y) between the olefin-based elastomer (x) and the crosslinking agent (y) is in a range of from 100:1 to 2:1.

14. The ink jet recording medium package of claim 12, wherein the self-adhesive layer comprises maleic acid-modified styrene-ethylene-butadiene-styrene copolymers, hexamethylene diisocyanate, and naphthene oil having 6 carbon atoms.

* * * * *